United States Patent [19]

Guenther

[11] 3,937,417

[45] Feb. 10, 1976

[54] APPARATUS FOR TENSIONING YARN

[75] Inventor: Lloyd M. Guenther, Severna Park, Md.

[73] Assignee: Chevron Research Company, San Francisco, Calif.

[22] Filed: Dec. 28, 1973

[21] Appl. No.: 429,055

[52] U.S. Cl. ..... 242/147 R; 242/149; 242/154

[51] Int. Cl.[2] ..... B65H 59/10; B65H 59/24; B65H 59/26

[58] Field of Search ..... 242/147 R, 149, 153, 154

[56] References Cited

UNITED STATES PATENTS

| | | | |
|---|---|---|---|
| 745,123 | 11/1903 | Tuseth | 242/149 |
| 2,630,836 | 3/1953 | Cole | 242/149 X |
| 2,750,130 | 6/1956 | Heizer et al. | 242/149 |
| 2,920,772 | 1/1960 | Wilhelm et al. | 242/154 X |
| 2,981,497 | 4/1961 | Schurich | 242/149 |

FOREIGN PATENTS OR APPLICATIONS

| | | | |
|---|---|---|---|
| 1,248,248 | 10/1960 | France | 242/149 |

*Primary Examiner*—Stanley N. Gilreath
*Attorney, Agent, or Firm*—G. F. Magdeburger; J. Stoner, Jr.

[57] ABSTRACT

Yarn tensioning apparatus particularly suitable for receiving essentially tensionless yarn and giving it a generally uniform output tension level includes friction surfaces across which the yarn is drawn to progressively raise the tension level and work out tangles. The tension surfaces are long, so that, in passing transversely over them, the yarn may take a variety of paths to accommodate the abrupt fluctuations associated with tangle release events. Near the output, a member having a friction nose at one end is pivoted at its opposite end and includes a curved intermediate portion that may swing down to contact a yarn engaging portion of a friction pin; the arrangement being such that an increase in yarn tension causes movement of the member relative to the pin in a direction to produce tension-reducing effects, and vice versa.

2 Claims, 4 Drawing Figures

APPARATUS FOR TENSIONING YARN

BACKGROUND AND FIELD OF THE INVENTION

This invention relates generally to a tensioner for yarn. More specifically, the invention relates to the progressive tensioning of a yarn from an essentially stress free condition to a condition of generally uniform tension.

Yarn tension devices are needed in many textile applications and a great variety of them have been used heretofore. In general, a yarn tension device includes some means for applying a retarding force to a linear movement of the yarn. Frequently in the past such retarding forces have for example been provided by friction surfaces and the present invention also is concerned with a yarn tension apparatus having friction surfaces for engaging a moving yarn.

Although the invention in some of its broader aspects may be applicable to various yarn tensioning needs in the textile field, it includes features of particular significance in connection with the task of elevating the tension level of a yarn from essentially zero to some substantial level suitable for winding the yarn onto a package. Such applications are particularly difficult ones from a number of aspects, and the apparatus must include a combination of features in order to be satisfactory.

On the one hand, the output yarn tension level must be generally uniform if the yarn is to be handled by conventional take-up or winding equipment. The conventional take-up machines usually are themselves provided with yarn tension devices of some sort but these typically are not intended to function efficiently in instances where there are very large tension variations in the output yarn. Hence, for an application where yarn is being removed from, for example, a pile and delivered to a winding machine, the interposition of an extra tensioning system is necessary in order that the yarn input to the winding machinery may occur at a generally uniform tensions level.

On the other hand, attainment of a reasonably uniform tension level must not interfere with the practical requirements imposed by the need to obtain high production rates. That is, the apparatus must be so constructed as to minimize down time and to operate at high linear yarn feed rates. Various known devices which seem, on a theoretical basis, appropriate for producing output tension uniformity, fail to accommodate satisfactorily these practical factors and they are not suitable for use in the type of commercial application for which the present invention has proved especially beneficial. For an example of such a device, reference may be made to U.S. Pat. No. 2,331,261.

OBJECTS AND SUMMARY OF PREFERRED FORMS OF THE INVENTION

It is a particular object of the invention to provide a novel apparatus for uniformly tensioning a yarn in which the frictional surfaces are completely exposed and, therefore, readily accessible and which may thus be easily and conveniently threaded whenever necessary.

It is another object of the invention to provide an apparatus for uniformly tensioning a yarn in which the frictional surfaces are arranged to automatically catch and hold a yarn in the event the yarn breaks so as to prevent the yarn from slipping through the apparatus back into the source of the yarn.

It is yet another object of the invention to provide a novel apparatus for uniformly tensioning a yarn which can accommodate a large degree of lateral wandering of the yarn and which can effectively work tangles out of a tensionless yarn.

An apparatus for progressively converting a yarn from an initial essentially stress free condition to a final condition of essentially uniform tension according to a preferred embodiment of the invention intended to accomplish at least some of the foregoing objects includes a friction pin having a surface portion over which the yarn may be drawn and a control cooperating with the pin in a novel manner. The control preferably is in the form of a plate-like structure mounted for swinging movement about an axis parallel to the pin and including a yarn guide nose on the opposite side of the pin from the pivot axis. Between the pivot axis and the yarn guide nose, the control is provided with a curved section overlying the yarn contacting portion of the friction pin. The arrangement is such that a yarn may easily be threaded over the ends of the pin and control, into the space therebetween. When no tension is applied, as for example during a shut-down or after a yarn break in the processing equipment downstream from the tension device, the curved portion of the control plate tends to pinch or clamp the yarn against the friction surface to restrain the yarn against backward movement. However, when excessive tension develops during running conditions, the yarn tension tends to move the control away from the friction pin in such a way as to reduce the angle of contact both between the yarn and the pin and between the yarn and the friction nose of the control. This reduced contact has the effect of reducing drag forces on the yarn and compensating or counteracting the excessive tension condition. In this way, generally uniform tension in the output yarn is maintained under a variety of conditions.

The effectiveness of the friction pin and control arrangement is augmented in a particular preferred embodiment by the presence of other tensioning elements which exert desirable control effects upon yarn moving toward the zone of coaction between the friction pin and the control. These additional tensioning elements are especially advantageous in installations where kinky yarn must be removed from a loose pile, because they operate to work out tangles progressively and smoothly.

THE DRAWINGS

Other objects and advantages of the present invention will become apparent with reference to the detailed description to follow of a preferred embodiment thereof wherein like reference numerals have been applied to like elements in which.

DETAILED DESCRIPTION

Figure 1:
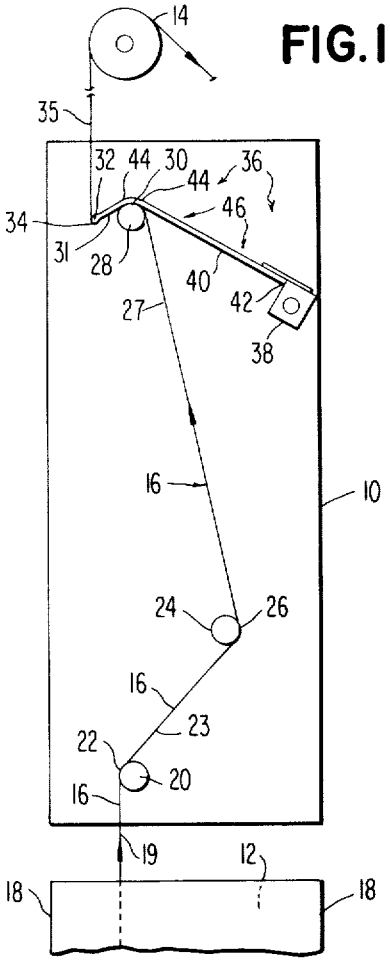
FIG. 1 is a side elevational view of an embodiment of the invention showing the general relation between a yarn and elements of the invention.

Referring to the drawings, a preferred embodiment of the invention can be seen to be comprised of a stanchion 10 carrying a plurality of tensioning means which are interposed between a suitable yarn source or reservoir 12 and a guide roll 14 from which the yarn is drawn to conventional take-up means (not shown). The reservoir 12 may contain a loose, unwound supply of a yarn 16 in an essentially stress free condition. The reservoir may take any suitable form. For instance, a receptacle commonly referred to as a J-box might be used, and it may be helpful to visualize the walls 18 in FIG. 1 as the walls of an outlet end portion of a J-box forming a source of tensionless yarn.

The take-up means is entirely conventional and need not be described here. The take-up means provide the force by means of which the yarn 16 is drawn around and over the tensioning means affixed to the stanchion 10.

In passing from the reservoir 12 to the idler roll 14, the yarn engages and is frictionally resisted by a series of tensioning means. As an essentially stress free length 19 of the yarn 16 passes from the reservoir 12 it first encounters and engages a first tensioning means 20 in the form of an elongated, smooth, cylindrical first friction pin which is rigidly and orthogonally cantilevered from the stanchion 10. It will be noted that the length of the arc 22 contacted by the yarn 16 depends upon the direction from which the yarn 16 approaches the pin 20. By virtue of this engagement of the first friction pin 20 by yarn 16 the passage of the yarn is frictionally resisted and a first magnitude of tension somewhat less than the desired uniform tension is introduced into the length 23 of the yarn 16. The engagement of the pin 20 by the yarn and the passage therearound also assists in guiding the yarn to a second tensioning means 24.

The second tensioning means 24 is located above and laterally offset from the first friction pin 20 in a direction away from the laterally facing arc 22 of the first pin. The second tensioning means is similar to the first tensioning means and is comprised of a smooth, cylindrical, second friction pin 24 which is rigidly and orthogonally cantilevered from the stanchion 10. By virtue of the engagement of the second friction pin by the yarn 16 as it passes around the arc 26, the passage of the yarn 16 is frictionally resisted and a second magnitude of tension greater than the first magnitude of tension but less than the desired uniform tension is introduced into the length 27 of the yarn 16. The contact with the second friction pin 24 also serves to guide the passage of the yarn to a third tensioning means 28.

The third tensioning means 28 is located in the upper portion of the stanchion 10 above the first friction pin 20. The third tensioning means can be seen to be comprised of a smooth, cylindrical, third friction pin 28 which is rigidly and orthongonally cantilevered from the stanchion 10. After passing from the second friction pin 24 the yarn 16 tangentially engages the third friction pin, passes over it, and is directed tangentially away. The arc of contact 30 between the friction pin 28 and the yarn 16 is variable and faces in a generally upward direction. By virtue of the engagement of the friction pin 28 by the yarn 16 the passage of the yarn over the friction pin is frictionally resisted and a third magnitude of tension greater than the second magnitude of tension but less than the desired uniform tension is introduced into the length 31 of the yarn 16.

From the third friction pin the yarn 16 advances around a fourth tensioning means 32. The fourth tensioning means is a friction nose, preferably in the form of a segment of a generally cylindrical surface which is engaged around a variable arc thereof 34 by the yarn 16. By virtue of the engagement between the yarn 16 and the variable arc 34 of the friction nose 32, the passage of the yarn around the friction nose is frictionally resisted and a fourth magnitude of tension greater than the third magnitude of tension and equal to the desired uniform tension is introduced into the length 35 of the yarn 16. Then as the yarn 16 passes from the reservoir 12 around and over the tensioning means to the idler roll 14, it is progressively tensioned from an initial stress free condition to a final condition of generally uniform tension.

In this regard it will be recalled that the arcs of contact 30 and 34 were referred to as variable arcs. The lengths of the arcs of contact 30 and 34 between the yarn 16 and the third friction pin 28 and the friction nose 32 vary in relation to the tension in the yarn portion 31. As the tension at 31 increases, the lengths of the arcs of contact 30 and 34 decrease. Thus, the occurrence of increased tension is accompanied automatically by an effect which tends to reduce tension and restore the preexisting tension level.

The variations in the lengths of the arcs of contact 30 and 34 between the yarn 16 and the third friction pin and the friction nose is accomplished through an arc varying means 36. The arc varying means can be seen to include an elongated base 38 which is rigidly and orthogonally cantilevered from a point of the upper portion of the stanchion 10 below the third friction pin, above the second friction pin and laterally displaced from both pins. An elongated planar stem 40 is coextensively and pivotally connected to a lateral portion 42 of the base 38, parallel to the longitudinal axis of the base. The pivotal connection preferably is established by a leaf spring type assembly, for example, an arcuate means 44 is rigidly, coextensively, and tangentially connected to the elongated planar stem 40 and forms a generally arcuate connecting member which fits over and partially around the third friction pin. In conjunction with the friction nose 32 mentioned earlier, the arcuate means or connection member 44 serves to direct the yarn from its initial tangential contact with the third friction pin over the variable arc of contact 30 with the pin to a point of final tangential contact. From this final point of contact, the yarn is conducted tangentially away from the pin in a direction generally not coinciding with the direction in which the yarn initial contacts the pin.

The friction nose 32 is rigidly and coextensively connected to an end of the arcuate connecting member 44 opposite the point at which the connecting member is tangentially connected to the elongated planar stem 40. The movable portion of the arc varying means 36, i.e., the planar stem 40, arcuate connecting member 44 and friction nose 32, can for convenience be referred to as arm 46. The arm 46 is biased pivotally against the third and fourth magnitudes of tension by the weight of the unit and by spring forces from the leaf spring means used to connect the arm 46 to the base 38, or other suitable biasing means. It is preferred that the mass of the arm 46 is kept as low as is feasible in order to minimize inertia effects which tend to promote bouncing of the arm. The biasing force normally desired is a light one such that normal yarn tensions will be sufficient to keep the arcuate member 44 from pressing the yarn against the pin 28.

Variations in the orientation of the movable arm 46 of the arc varying means 36 cause variations in the lengths of the arcs of contact 30 and 34 between the yarn and the third friction pin 28 and the friction nose 32 to compensate for fluctuations in tension levels. For example, if the tension should increase slightly, the arm 46 will pivot slightly upward, the length of the arcs 30 and 34 will decrease, and the tension will again decrease. Similarly, if the tension decreases, the arm 46 will pivot down, the length of the arcs 30 and 34 will increase, and the tension will increase again.

It will also be noted that the danger of a free end of the yarn falling back into the reservoir or other source is minimized by virtue of the fact that if the yarn should break, it will be caught between the arcuate connecting member and the third friction pin. By preventing the yarn from falling back into the source the end of the yarn will not be lost and the operator may be spared a possibly protracted search.

Figure 2:
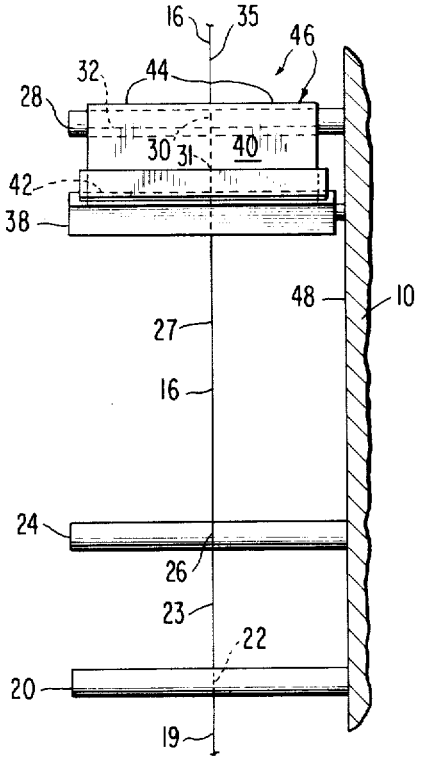
FIG. 2 is a partial end elevational view of the embodiment shown in FIG. 1.
Figure 4:
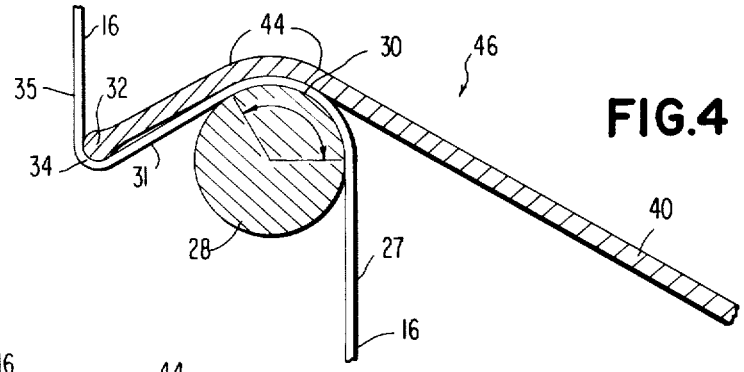
FIG. 4 is an enlarged side elevational view of a portion of the embodiment shown in FIG. 1 illustrating a yarn in engagement with a larger arc of a friction pin.
Figure 3:
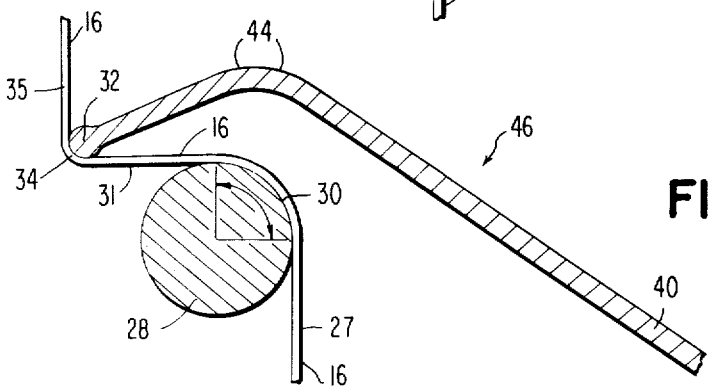
FIG. 3 is an enlarged side elevational view of a portion of the embodiment shown in FIG. 1 showing the yarn in engagement with an arc of a friction pin.

From FIG. 2, it will be observed that the ends of the various tensioning components 20, 24, 28, and 36 opposite the face 48 of the stanchion are unobstructed. This arrangement simplifies threading of the yarn 16 into place whenever necessary without any need for threading the yarn axially through an eyelet or the like. An operator need not even locate the actual yarn end in order to thread up the apparatus, because he can very simply slide a mid-portion of the yarn length laterally into place over the unobstructed free ends of the components and into contact with the friction surfaces on the first, second, and third friction pins and the friction nose. Such a simple threading procedure requires a minimum of time and skill.

FIG. 2 also shows the substantial width of zone over which the yarn path may vary during use of the apparatus. The stanchion 10 has a vertically extending, essentially planar surface 48 from which the first, second, and third friction pins and the elongated base of the arc varying means are rigidly and orthogonally cantilevered. As illustrated, the pins and the base are relatively long. In addition, it should be apparent that the elongated planar stem 40, the arcuate connecting member 44, and the friction nose 32 which comprise the arm 46 are essentially coextensive laterally with the length of the base 38 and the third friction pin 28. Thus, because of the elongated nature of the pins, base, and arm, the yarn 16 is free to wander along the length of the friction pins as it is drawn from the reservoir without the uniformity of tension ultimately developed in the yarn being adversely affected.

This freedom to wander is particularly significant in connection with the handling of tensionless yarns that may have loose tangles therein. Such tangles are best removed by gentle working actions at a plurality of points and, as has been explained above, this type of action is provided by the present invention wherein the yarn is progressively tensioned from an essentially stress free condition to a condition of generally uniform tension by the passage of the yarn over the friction pins and the friction nose. A tangle moving upwardly through the system may fall apart at any one of a plurality of levels, and when it does, there is a sudden disturbance to the system which promotes lateral and other displacements of the yarn. The illustrated structure is well suited for the handling of such irregularities.

SUMMARY OF MAJOR ADVANTAGES

It will be appreciated that in providing an apparatus for uniformly tensioning a yarn according to the present invention, certain significant advantages are obtained.

In particular, the unique posture and configuration of the friction surfaces of the invention allow it to be quickly and conveniently threaded.

In addition, the arrangement and relation between the friction surfaces ensures that the yarn will not fall back into the source should the yarn break.

A further advantage resides in the fact that the elongated configuration of the friction surfaces affords complete freedom for the yarn to wander as it is being drawn from the source.

In describing the invention, reference has been made to a preferred embodiment. However, those skilled in the art and familiar with the disclosure of the invention will recognize that certain additions, deletions, substitutions, or other modifications may be made within the purview of the invention as defined in the claims.

What is claimed is:

1. Yarn tension apparatus through which yarn from a reservoir where the yarn is in an essentially tension free condition may be drawn to release tangles and to establish a tension level sufficient for winding of the yarn onto a package, comprising support means;

a stationary elongated friction member fixed to said support means and protruding outwardly therefrom, said member having an unobstructed free end over which a mid-portion of a length of yarn may be passed to dispose the yarn in contact with and leading transversely across a friction surface extending longitudinally of said member, said friction surface being curved transversely about the longitudinal axis of said member and having a longitudinal extent sufficient to permit substantial migrations of the yarn along the friction surface during tangle release events without the yarn passing off the unobstructed free end of the friction member; and a control member mounted on said support means for swinging movement about an axis spaced from but parallel to the longitudinal axis of said friction member, said control member having an unobstructed free end opposite said support means and including a longitudinally elongated, transversely curved portion adapted to swing toward said curved friction surface of said friction member to press a yarn portion against such surface when tension is released, so as to engage said yarn portion between said curved portion and said friction surface to inhibit accidental unthreading of the yarn from between said friction member and said control member by yarn movement along the length of the yarn, and a yarn guide portion spaced from said curved portion on the side thereof opposite the pivot axis, said yarn guide portion including a longitudinally elongated guide surface about which the yarn may pass in a direction such that an increase in yarn tension tends to swing said control member away from said friction member to reduce the length of the arc of frictional contact between the yarn and said friction surface and thereby effect a tension reduction tending to compensate for said tension increase, said curved portion of said control member and said yarn guide portion of said control member being fixed relative to each other so that any movement of said yarn guide portion results in movement of said curved portion.

2. Yarn tensioning apparatus for progressively converting a yarn from an initial essentially stress free condition to a final condition of generally uniform tension as said yarn passes upwardly from a yarn source toward yarn take-up means, said yarn tensioning apparatus comprising:

a stanchion having at least one vertically disposed, essentially planar surface;

first tensioning means for initially tensioning the yarn from said yarn source from the initial essentially stress free condition to a first magnitude of tension less than the magnitude of the generally uniform tension of said final condition of the yarn, said first tensioning means including:

a single, smooth, cylindrical first friction pin rigidly and orthogonally cantilevered from a lower portion of said planar surface, a generally laterally facing arc of said first friction pin being engaged by the yarn and passage of the yarn around said first friction pin being frictionally resisted and guided thereby;

second tensioning means for tensioning the yarn from the first magnitude of tension to a second magnitude of tension greater than the first magnitude of tension but less than the magnitude of the generally uniform tension of the final condition of the yarn, said second tensioning means including a single, smooth second friction pin rigidly and orthogonally cantilevered from said essentially planar surface above and laterally offset from said first friction pin in a direction away from said laterally facing arc of said first friction pin, a generally laterally facing arc of said second friction pin being engaged by the yarn and the passage of the yarn around said friction pin being frictionally resisted and guided thereby;

third tensioning means for tensioning the yarn from the second magnitude of tension to a third magnitude of tension greater than the second magnitude of tension but less than the magnitude of the generally uniform tension of the final condition of the yarn, said third tensioning means including a single, smooth, cylindrical third friction pin rigidly and orthogonally cantilevered from an upper portion of said planar surface above said first friction pin, a variable, generally upwardly facing arc of said third friction pin being engaged by the yarn and the passage of the yarn over said third friction pin being frictionally resisted and guided thereby;

arc varying means for varying the length of the arc of said third friction pin engaged by the yarn, said arc varying means including an elongated base rigidly and orthogonally cantilevered from a point on said essentially planar surface below said third friction pin, above said second friction pin, and laterally displaced from said third friction pin, an elongated planar stem pivotally connected to said elongated base parallel to the longitudinal axis of said elongated base, and arcuate means connected to said planar stem and forming a generally arcuate surface which extends from said connection with said planar stem over and partially around said third friction pin and the yarn engaging said third friction pin; and fourth tensioning means for tensioning the yarn from the third magnitude of tension to a fourth magnitude of tension equal to the generally uniform tension of the final condition of the yarn, said fourth tensioning means being connected to an end of said arcuate means opposite said planar stem and comprising a generally arcuate frictionally surface which is variably engaged by the yarn in passing from beneath said arcuate means, said fourth tensioning meansn being biased against the tension of the final condition of the yarn to automatically alter the arcs of contact of said yarn with said third and fourth tensioning means in response to tension variation, and said arcuate means being swingable into clamping cooperation with said third friction pin in the absence of tension in the yarn beyond said fourth tensioning means.

* * * * *